United States Patent [19]

Kawasaki et al.

[11] Patent Number: 4,700,411

[45] Date of Patent: Oct. 20, 1987

[54] HELMET

[75] Inventors: Kazuhiro Kawasaki; Akio Muranaka, both of Saitama, Japan

[73] Assignee: Honda Giken Kogyo Kabushiki Kaisha, Tokyo, Japan

[21] Appl. No.: 798,605

[22] Filed: Nov. 15, 1985

[30] Foreign Application Priority Data

Nov. 16, 1984 [JP] Japan ..... 59-17318[U]

[51] Int. Cl.[4] ..... A42B 3/02

[52] U.S. Cl. ..... 2/425; 2/171.3

[58] Field of Search ..... 2/171.3, 425, 424, 436, 2/437

[56] References Cited

U.S. PATENT DOCUMENTS

| | | | |
|---|---|---|---|
| 4,081,865 | 4/1978 | Bergee et al. | 2/425 |
| 4,115,874 | 9/1978 | Hasegawa | 2/425 |
| 4,519,099 | 5/1985 | Kamiya et al. | 2/171.3 X |

*Primary Examiner*—Louis K. Rimrodt

*Attorney, Agent, or Firm*—Lyon & Lyon

[57] ABSTRACT

A helmet having a ventilation system which employs a detachable visor. The visor forms an inner chamber which inhibits foreign objects from entering the ventilation passages in the interior of the helmet.

3 Claims, 6 Drawing Figures

FIG. 1.
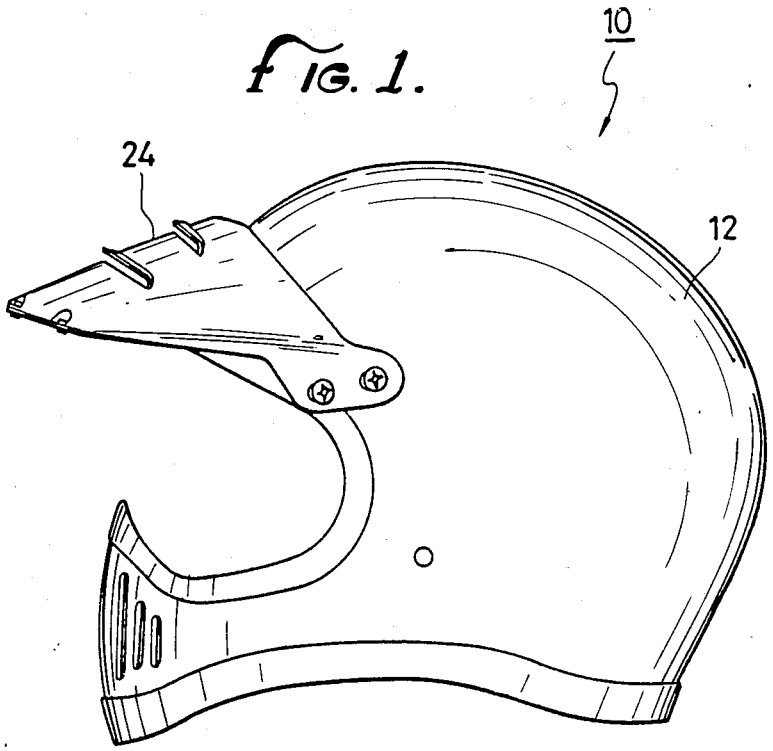
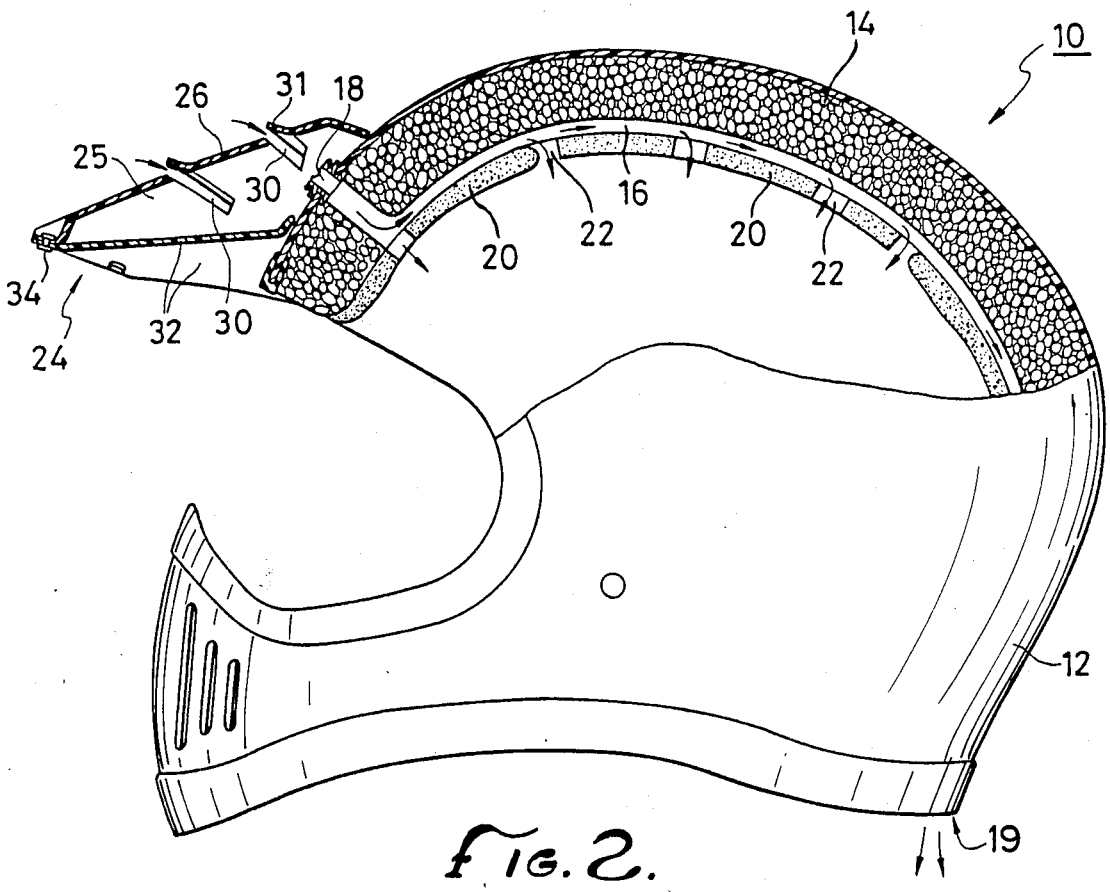
FIG. 2.

HELMET

BACKGROUND OF THE INVENTION

The field of the present invention is ventilation systems for helmets.

Currently helmets for motorcycles and other open air vehicles generally employ shock-absorbing liners, suspension mechanisms and the like to protect against head injuries in case of impact. Such systems have a propensity to retain heat inside the helmet creating discomfort and distraction for the rider.

Air ventilation systems for helmets have been proposed. An example is illustrated in U.S. Pat. No. 4,519,099 which uses a visor and adjacent guide plates to direct onrushing air directly into the helmet interior for ventilation purposes, the disclosure of which is incorporated herein by reference. However, such ventilation systems can allow the introduction of foreign objects and particles into the interior of the helmet, thereby increasing the weight of the helmet and blocking the ventilation passages. Also, if foreign objects accumulate inside the helmet, they are difficult to remove without disassembling the helmet.

SUMMARY OF THE INVENTION

The present invention relates to ventilation systems in helmets having air channels for receiving onrushing air created by forward movement.

A helmet visor channels onrushing air into an inner chamber of the visor. In this way, foreign objects, including particles and dust, are left in the inner chamber before the air is directed inside the helmet. In a further aspect of the invention, foreign objects can be easily removed by detaching the visor from the outside of the helmet.

Accordingly, it is an object of the present invention to provide an air ventilation system which dissipates heat from inside a helmet and which prevents foreign objects from accumulating inside the helmet. Other objects and advantages will appear hereinafter.

DESCRIPTION OF THE DRAWINGS

FIG. 1 is a side view of a helmet and visor.

FIG. 2 is a sectional side view of the helmet and visor of FIG. 1.

FIG. 1 illustrates a helmet, generally designated 10, which includes a helmet body 12 and a visor 24. FIG. 2 illustrates the same view in crosssection. The helmet body 12 consists of a hard plastic resin composite such as a fibre-reinforced plastic and a shock-absorbing inner liner 14 made of, for example, foamed styrol. A plurality of air channels 16 run from the front to the rear of the helmet body 12. A plurality of pads 20 made of cushion material such as foamed polyurethane contacts the head of the wearer and covers over the channels 16 to form passageways about the helmet. A plurality of air openings 22 between and through the pads 20 communicate between the channels 16 and the interior of the helmet. Air is introduced to the air channels 16 through air inlets 18 in the forehead portion of the helmet body 12. The air escapes from inside the helmet body 12 through an air outlet 19 at the rear of the helmet body 12 and from around the head of the wearer.

FIG. 2 also illustrates the visor 24 which consists of an upper wall 26, a bottom wall 32, and an inner chamber 25 which is formed between the upper wall 26, the bottom wall 32 and the forehead portion of the helmet body 12. The onrushing air created by the movement of an open air vehicle upon which the wearer may be riding is introduced to the inner chamber 25 of the visor 24 through air guide openings 30 after being captured by the air guides 31. The velocity of the onrushing air is reduced in the inner chamber 25, and thus foreign particles tend to be left in the inner chamber 25. The air is then introduced to the interior of the helmet body 12 through air inlet orifices 18.

FIG. 3 depicts the forehead portion of the helmet body 12 with the visor 24 detached. The visor 24 is fixed to the helmet body by means of bolts 40, visor holes 28 and inset nuts 13. Other fastening mechanisms may be equally applicable. The holes 28 may be elongated for vertical adjustment of the visor 24 on the helmet 12. The visor 24 is thus easily detachable so that any foreign objects or dust can be easily removed from the inner chamber 25. Also, the upper wall 26 and the bottom wall 32 are attached to one another by means of rivets 34.

Figure 3:
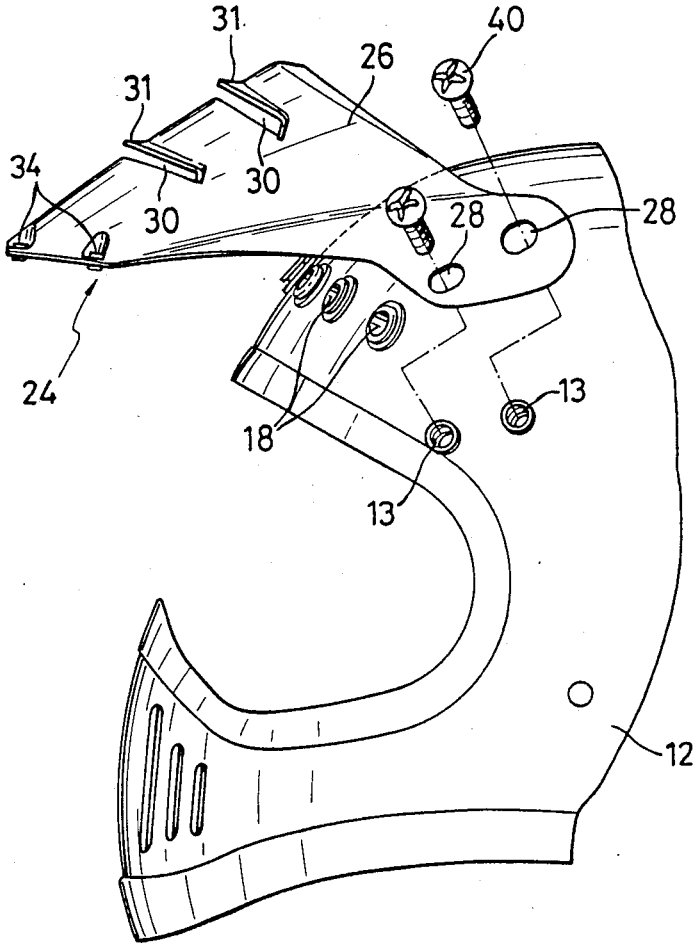
FIG. 3 is an exploded assembly view of the helmet and visor of FIG. 1.
Figure 4:
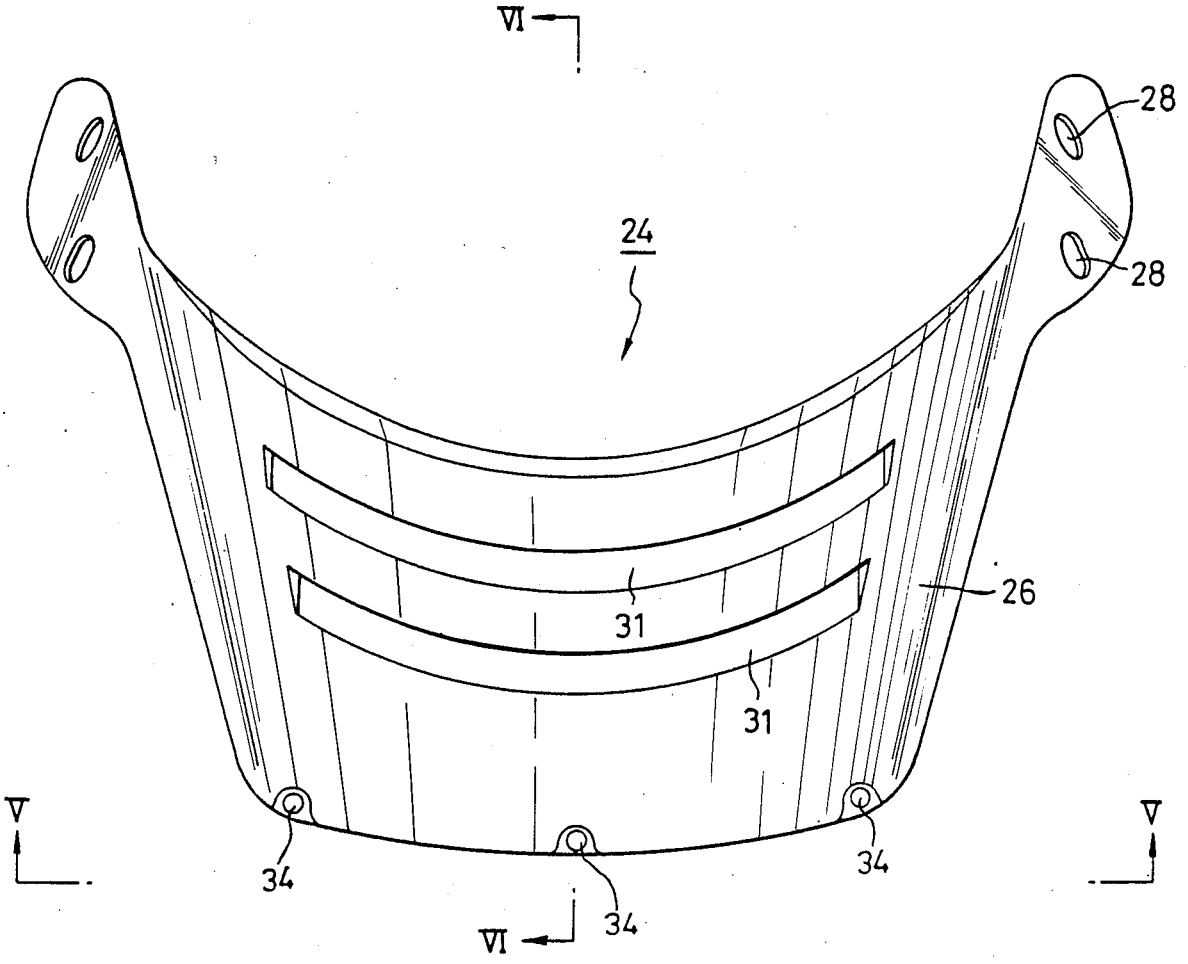
FIG. 4 is a plane view of the visor of FIG. 1.
Figure 5:
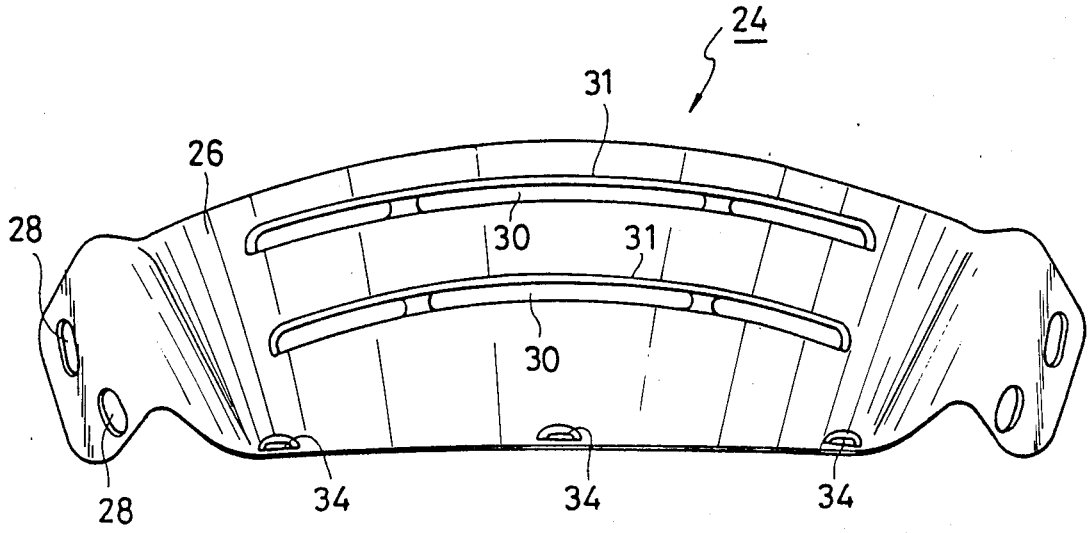
FIG. 5 is a front view of the visor taken along line V—V of FIG. 4.
Figure 6:
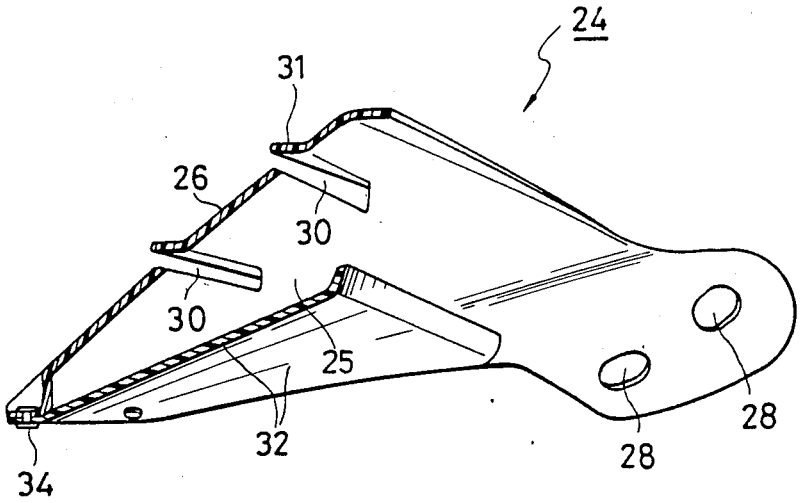
FIG. 6 is a sectional side view of the visor taken along line VI—VI of FIG. 4. DETAILED DESCRIPTION OF THE PREFERRED EMBODIMENT Turning in detail to the drawings.

When a rider on an open air vehicle faces forward such that the wind is impacting the front of the helmet, air will be collected by the guides 31 and enter the inner chamber 25 through the inlet orifices 30 to be compressed to a considerably elevated pressure. The air is then forced through the air paths 16. Because of the inner chamber 25 inside the visor covering the inlet orifices 18, the dust and particles entering the openings 30 with the air tend to drop out of the air flow. The velocity of the flow is decreased in the inner chamber 25 such that the air will be cleaned prior to entering the air paths 16 through the orifices 18.

With the visor 24 having the inner chamber 25, it is possible to reduce the amount of dust and the like collecting in the helmet. Thus, good ventilation can be maintained. Also, the chamber construction permits the elevated air pressure in the chamber 25; consequently, the efficiency of ventilation can be improved throughout the helmet. Dust and the like which is caught and collected in the visor 24 can be eliminated by removing the visor 24 and washing it with water.

Therefore, a helmet ventilation system is disclosed which reduces the discomfort and distraction of a rider of an open air vehicle without introducing foreign matter into the interior of the helmet. While certain embodiments of this invention have been disclosed, it would be apparent to those skilled in the art that many other embodiments are possible without departing from the inventive concepts herein. The invention is thus not to be restricted except in the spirit of the appended claims.

What is claimed is:

1. A helmet comprising a helmet body having ventilation and inlets through a forward portion of said helmet body; and a visor extending forwardly of said helmet body and having an upper wall which inclines upwardly from its forward end towards said helmet body, and a bottom wall fixed to said upper wall, said bottom and upper walls together with said forward portion of said helmet body defining a generally triangular inner chamber therebetween in communication with said inlets, said upper wall having air guide openings into said inner chamber facing forwardly of said helmet body, said air guide openings being slots extending substanially across said upper wall, such that airborn particles in an air stream enterining said air guide openings are generally left in said inner chamber before the air stream enters said helmet body.

2. A helmet as claimed in claim 1 including fastening means for detachably affixing visor to the helmet body.

3. A helmet as claimed in claim 1, wherein the guide openings act to cause dust entrained with incoming air to flow downwardly towards the bottom wall of the inner chamber, and thereby inhibit passage through inlets.

* * * * *